US008500097B2

(12) United States Patent
Jones

(10) Patent No.: US 8,500,097 B2
(45) Date of Patent: Aug. 6, 2013

(54) FLOORING ELEMENT LOCATOR INCLUDING A SUBSTANTIALLY CIRCULAR SPACING MEMBER

(76) Inventor: William Lewis Jones, Potters Bar (GB)

( * ) Notice: Subject to any disclaimer, the term of this patent is extended or adjusted under 35 U.S.C. 154(b) by 1340 days.

(21) Appl. No.: 11/122,753

(22) Filed: May 5, 2005

(65) Prior Publication Data

US 2005/0252166 A1 Nov. 17, 2005

Related U.S. Application Data

(63) Continuation of application No. PCT/GB03/04732, filed on Nov. 4, 2003.

(30) Foreign Application Priority Data

Nov. 6, 2002 (GB) ..... 0225901.8

(51) Int. Cl.
*E04G 21/18* (2006.01)
*B66F 19/00* (2006.01)

(52) U.S. Cl.
USPC ..... 254/11; 52/747.1

(58) Field of Classification Search
USPC ... 269/165, 91, 122; 254/11, 15, 17; 52/747.1
See application file for complete search history.

(56) References Cited

U.S. PATENT DOCUMENTS

| | | | | |
|---|---|---|---|---|
| 994,722 | A | 6/1911 | Cutler | |
| 1,266,253 | A | 5/1918 | Hakanson | |
| 2,371,730 | A | 3/1945 | Ausland | |
| 2,948,507 | A * | 8/1960 | Gould | 254/15 |

FOREIGN PATENT DOCUMENTS

| | | |
|---|---|---|
| DE | 619088 | 9/1935 |
| DE | 19517820 | 1/1997 |
| WO | WO 02/06609 A1 | 1/2002 |

* cited by examiner

*Primary Examiner* — Michael Safavi
(74) *Attorney, Agent, or Firm* — Dierker & Associates, P.C.

(57) ABSTRACT

A method of locating a flooring element includes: laying a flooring element; providing a spacing member; positioning the spacing member between the flooring element and a fixed element; providing a separating member, the separating member having first and second faces inclined at an angle to one another so that at least a part of the separating member is in the form of a wedge having a wider end and a narrower end; positioning the separating member so that one of the first and second faces contacts the flooring element and the other of the first and second faces contacts the spacing member; and driving the separating member between the flooring element and the spacing member in a direction passing from the wider end of the wedge to the narrower end thereof, thereby exerting forces on the flooring element and the spacing member in directions to separate the flooring element and the spacing member.

6 Claims, 3 Drawing Sheets

FLOORING ELEMENT LOCATOR INCLUDING A SUBSTANTIALLY CIRCULAR SPACING MEMBER

CROSS REFERENCE TO RELATED APPLICATIONS

This application is a continuation of currently pending International Application No. PCT/GB2003/004732, filed Nov. 4, 2003, which itself claims the priority of GB0225901.8, filed Nov. 6, 2002, the contents of which are incorporated herein by reference in their entirety.

BACKGROUND

The present disclosure relates to a method of locating a flooring element, and in particular concerns a method of easily pressing flooring elements into position in confined spaces and with minimal equipment.

When laying a floor composed of flooring elements or boards having substantially rectangular cross sections, it is desirable to force each newly-laid board against the adjacent previously-laid boards to locate the new board properly. Conventionally, this is achieved by the use of a device which is positioned over the leading edge of a newly-laid board, and which is adapted to drive a nail through the side of the board and into the supporting surface beneath in a diagonal direction. The device includes a protruding surface which, when struck with a hammer or other suitable large object, drives the nail through the board and supporting surface. It will be appreciated that the force of the driving of the nail into the side of the board pushes the newly-laid board up against the previously-laid adjacent boards, and the passage of the nail into the supporting surface beneath secures the board in this position. The driving of the nail into a side surface of the board also means that the head of the nail, or the hole made by the nail, are not visible on the top surface of the board once the floor has been completely laid.

There are, however, drawbacks associated with this technique. For instance, the device used to drive nails through newly-laid boards is typically rather bulky and heavy, and awkward to transport from one site to another or move around a room while a floor is laid therein.

In addition, it will be appreciated that, as the laying of a floor nears completion, the wall of the room adjacent the part of the supporting surface which has not yet had boards laid thereon will inhibit the swinging of a hammer against the protruding surface of the device, thus making operation of the device awkward or ineffective.

It has been proposed to locate flooring elements by bracing two substantially wedge-shaped elements between a newly-laid flooring element and a fixed opposing surface (e.g. a wall). The wedge elements are oriented so that their respective narrow ends point in opposite directions, and one of the wedge elements is then driven in a direction passing from the wider end thereof to the narrow end thereof. As this occurs, the wall and the newly-laid flooring element are driven apart, but since the wall is solidly fixed the net result will simply be the movement of the newly-laid flooring element.

It has been found, however, that substantial amounts of friction are generated using this method, thus resulting in short life-spans for the wedge-shaped components, and the requirement to expend a relatively large amount of effort in driving the wedge-shaped member.

As such, it would be desirable to provide a method and apparatus to substantially alleviate some or all of the above difficulties.

SUMMARY

A method of locating a flooring element is disclosed which includes laying a flooring element and providing a spacing member having a pair of substantially arcuate surfaces. The spacing member is positioned between the flooring element and a fixed element so that one of the substantially arcuate surfaces contacts the fixed element. The method further includes providing a separating member, the separating member having first and second faces inclined at an angle to one another so that at least a part of the separating member is in the form of a wedge having a wider end and a narrower end. The separating member is positioned so that one of the first and second faces contacts the flooring element, and the other of the first and second faces contacts the other of the substantially arcuate surfaces of the spacing member. The separating member is driven between the flooring element and the spacing member in a direction passing from the wider end of the wedge to the narrower end thereof, thereby exerting forces on the flooring element and the spacing member in directions to separate the flooring element and the spacing member. A flooring element locator including the separating member and the spacing member is also disclosed.

BRIEF DESCRIPTION OF THE DRAWINGS

Objects, features and advantages of embodiments of the present disclosure may become apparent by reference to the following detailed description and drawings, in which like reference numerals correspond to similar, though not necessarily identical components. For the sake of brevity, reference numerals having a previously described function may not necessarily be described in connection with other drawings in which they appear.

DETAILED DESCRIPTION OF THE EMBODIMENTS

Figure 1:
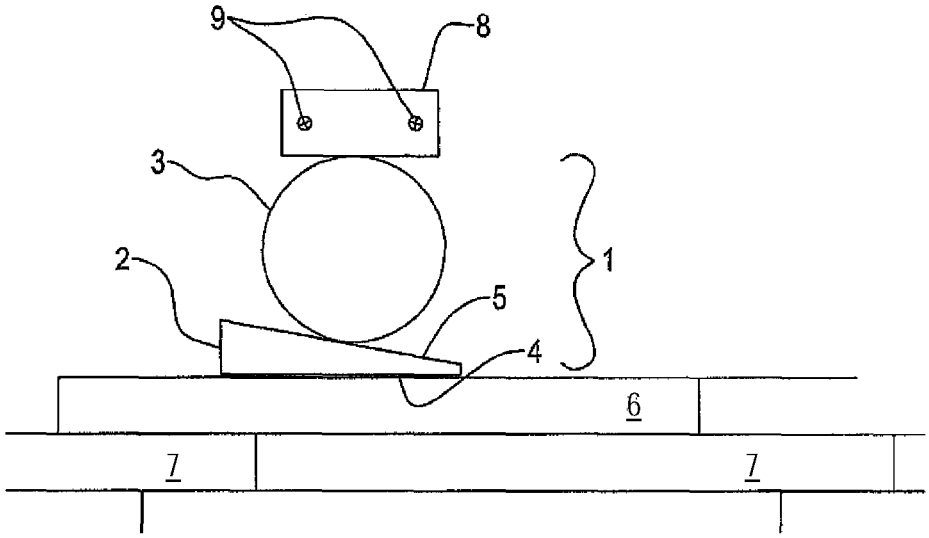
FIG. 1 shows a flooring element locator according to an embodiment.

The embodiment(s) of the present disclosure will be described generally immediately below and more specifically hereinafter in reference to the drawings.

One aspect of the present disclosure provides a method of locating a flooring element, including the steps of: laying a flooring element; providing a spacing member having a pair of substantially arcuate surfaces; positioning the spacing member between the flooring element and a fixed element so that one of the substantially arcuate surfaces contacts the fixed element; providing a separating member, the separating member having first and second faces inclined at an angle to one another so that at least a part of the separating member is in the form of a wedge having a wider end and a narrower end; positioning the separating member so that one of the first and second faces contacts the flooring element and the other of the first and second faces contacts the other of the substantially arcuate surfaces of the spacing member; and driving the separating member between the flooring element and the spacing member in a direction passing from the wider end of the wedge to the narrower end thereof, thereby exerting forces on the flooring element and the spacing member in directions to separate the flooring element and the spacing member.

Advantageously, the step of providing a spacing member includes the step of providing a spacing member having a surface thereof that contacts the separating member which is inclined with respect to a surface thereof that contacts the fixed element, so that, when the separating member is positioned so that one of the first and second faces contacts the flooring element and the other of the first and second faces contacts the spacing member, the surfaces of the spacing member and the separating member that contact one another are substantially parallel.

The step of providing a spacing member may include the step of providing a spacing member having a substantially circular cross section.

Conveniently, the method further includes the step of securing the fixed element to a surface upon which the flooring element is laid.

Advantageously, the method further includes the step of forming a groove in at least the one of the first and second faces of the separating member that contacts the flooring element.

Another aspect of the present disclosure provides a flooring element locator including: a separating member having first and second faces inclined at an angle to one another, so that at least a part of the separating member is in the form of a wedge having a wider end and a narrower end; and a spacing member having a pair of substantially arcuate surfaces, the separating member being drivable between the separating member and a fixed element in a direction passing from the wider end thereof to the narrower end thereof, thereby exerting forces on the flooring element and the spacing member in directions to separate the flooring element and the spacing member.

The surface of the spacing member that contacts the separating member may be inclined with respect to an opposite surface thereof, so that, when the separating member is positioned so that one of the first and second faces contacts the flooring element and the other of the first and second faces contacts the spacing member, the surfaces of the spacing and the separating member that contract one another are substantially parallel.

Conveniently, the spacing member has a substantially circular cross section.

A further aspect of the present disclosure provides a method of locating a flooring element, the method including the steps of: laying a flooring element across a pair of spaced apart supporting beams; providing a removable surface including a substantially planar sheet, a raised lip protruding from the plane of the sheet, and a pair of attachment sites by which the removable surface may be attached to the beams; placing the removable sheet across the pair of beams such that an edge of the sheet lies close to the flooring element; attaching the removable surface to the beams; placing a spacing member on the sheet between the flooring element and the raised lip so that the spacing member contacts the raised lip; providing a separating member having first and second faces inclined to one another so that at least a part of the separating member is in the form of a wedge having a wider end and a narrower end; placing the separating member on the sheet so that one of the first and second faces contacts the flooring element and the other of the first and second faces contacts the spacing member; and driving the separating member between the flooring element and the spacing member in a direction passing from the wider end of the wedge to the narrower end thereof, thereby exerting forces on the flooring element and the spacing member in directions to separate the flooring element and the spacing member.

Another aspect of the present disclosure provides a method of exerting a pushing force on a moveable element, including the steps of: providing a moveable element; providing a spacing member having a pair of substantially arcuate surfaces; positioning the spacing member between the moveable element and a fixed element so that one of the substantially arcuate surfaces contacts the fixed element; providing a separating member, the separating member having first and second faces inclined at an angle to one another so that at least a part of the separating member is in the form of a wedge having a wider end and a narrower end; positioning the separating member so that one of the first and second faces contacts the moveable element and the other of the first and second faces contacts the other of the substantially arcuate surfaces of the spacing member; and driving the separating member between the moveable element and the spacing member in a direction passing from the wider end of the wedge to the narrower end thereof, thereby exerting forces on the moveable element and the spacing member in directions to push the moveable element away from the spacing member.

Turning to FIG. 1, a flooring element locator 1 embodying the present disclosure is shown. The flooring element locator 1 includes a separating member 2 and a spacing member 3.

At least a part of the separating member 2 is substantially wedge-shaped in cross section, including first and second separating faces 4, 5 which are inclined at an angle to one another. The separating member 2 is substantially planar, and has approximately the same depth as the flooring elements with which the flooring element locator is to be used.

The spacing member 3 is substantially circular in cross section, and is also substantially planar, having a depth approximately equal to that of the flooring elements.

The separating member and spacing member may be formed from a tough, durable material that is unlikely to crack and also unlikely to mark or damage flooring elements or walls. An example of such a material is high-density polyethylene, although the embodiment(s) herein is/are not limited to this material.

The flooring element locator 1 can be used to locate a newly-laid flooring element 6, which is laid against a row of previously-laid, substantially parallel flooring elements 7.

Firstly, a fixed element 8 is provided on a supporting surface (not shown) upon which the floor is being laid. The fixed element 8 may be secured to the supporting surface by means of screws 9, or any other suitable means. The fixed element 8 may include a robust, substantially rectangular member, and is arranged so that one of the major surfaces thereof is substantially parallel to an edge of the newly-laid flooring element 6. The distance from the newly-laid flooring element 6 that the fixed element 8 should be positioned will become apparent from the description below.

Next, the spacing element 3 is laid flat between the fixed element 8 and the newly-laid flooring element 6, so that one edge of the spacing member 3 contacts the fixed element 8.

The separating member 2 is then placed between the newly-laid flooring element 6 and the spacing member 3, so that one of the separating faces 4 contacts the newly-laid flooring element 6, and the other of the separating faces 5 contact a surface of the spacing member 3. It will be appreciated that, due to the wedge shape of the separating member 2, the narrow end of the separating member 2 may be inserted into the space between the spacing member 3 and the newly-laid flooring element 6, and the separating member 2 can then be pushed in a direction from the wider end thereof to the narrower end thereof until the respective separating faces 4, 5 contact the appropriate components.

Once the spacing member 3 and separating member 2 are in position, a force is applied to the separating member 2, in a direction passing from the wider end thereof to the narrower end thereof. This force may be applied by, for instance, striking the wider end of the separating member 2 with a hammer. This force will drive the separating member 2 in the direction passing from the wider end thereof to the narrower end thereof, and it will be appreciated that, as this occurs, the spacing member 3 will rotate with respect to the fixed element 8 and to the separating member 2, thereby facilitating the relative motion of these two components and reducing the friction that must be overcome to effect the motion.

It will be appreciated that the driving of the separating member 2 in the direction passing from the wider end thereof to the narrower end thereof will exert forces on the newly-laid flooring element 6 and the spacing element 3 (and hence ultimately the fixed element 8) in a direction to separate the fixed element 8 and the newly-laid flooring element 6. Since the fixed element 8 is secured to the supporting surface upon which the floor is being laid, and the newly-laid flooring element 6 is not secured to the surface, it will be appreciated that these forces will have little effect in moving the fixed element 8, but will drive the newly-laid flooring element 6 against the adjacent previously-laid flooring element 7, thus properly locating the newly-laid flooring element 6.

Once this operation has been completed, the separating element 2 can be removed by applying a force to the narrower end thereof in a direction passing from the narrower end thereof to the wider end thereof, the fixed element 8 can be removed and the flooring element locator 1 is then ready to be stored away or used to locate a new flooring element.

In the above example, the spacing member 3 is placed against a rectangular fixed element 8, which is fixed to the supporting surface. However, the fixed element may include a wall of the room in which the floor is being laid. Alternatively, a rectangular block may be placed against the wall, in any orientation, to provide a suitably robust surface.

Figure 2:
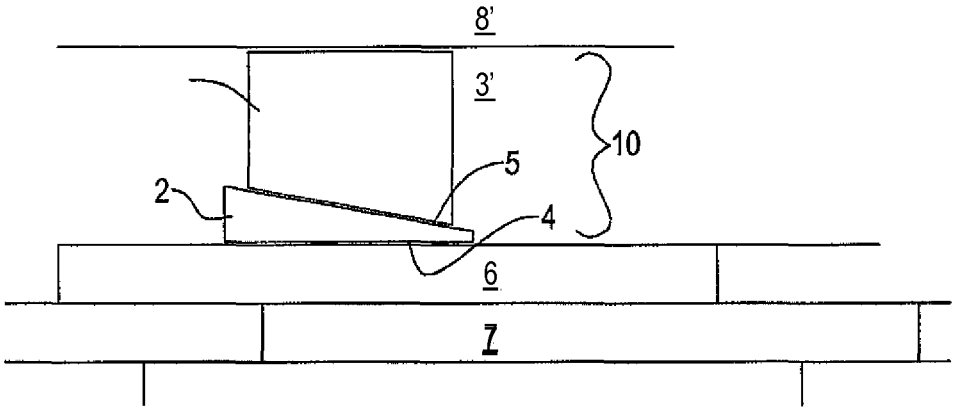
FIG. 2 PRIOR ART
FIG. 2 shows a known flooring element locator.

FIG. 2 shows a known flooring element locator 10 as discussed above. The known flooring element locator 10 again includes a wedge-shaped separating element 2, however the spacing member 3 is not circular in cross section, but has a quadrilateral cross section, two opposing sides of which are substantially parallel, and the other two opposing sides of which are inclined at an angle to one another. The angle of inclination between these two opposing sides is approximately equal to the angle of inclination between the first and second separating faces 4, 5 of the separating member 2.

The separating member 2 is then driven between the spacing member 3 and the newly-laid flooring element 6, in the same way as described above, and the driving of the separating element 2 between the spacing member 3 and the newly-laid flooring element 6 locates the newly-laid flooring element 6. However, since the separating element 2 and the spacing member 3 must slide past each other as the separating element 2 is driven, large quantities of friction must be overcome to drive the separating element 2. It will be appreciated that this will lead to the need for a greater force to drive the separating element, as well as wearing the components out more quickly when compared to the above-described apparatus embodying the present embodiment(s).

It is sometimes desired to lay flooring elements across a series of spaced-apart parallel joists, which do not rest on a fixed supporting surface. For instance, the joists may include the floor of a loft portion of a house. Clearly, since the portions of the boards which do not rest on the joists are above an empty space, it has proved problematic to lay flooring elements easily or reliably in such circumstances.

Embodiment(s) of the present disclosure also provide a removable supporting surface for use with the flooring element locator discussed above.

Figure 3:
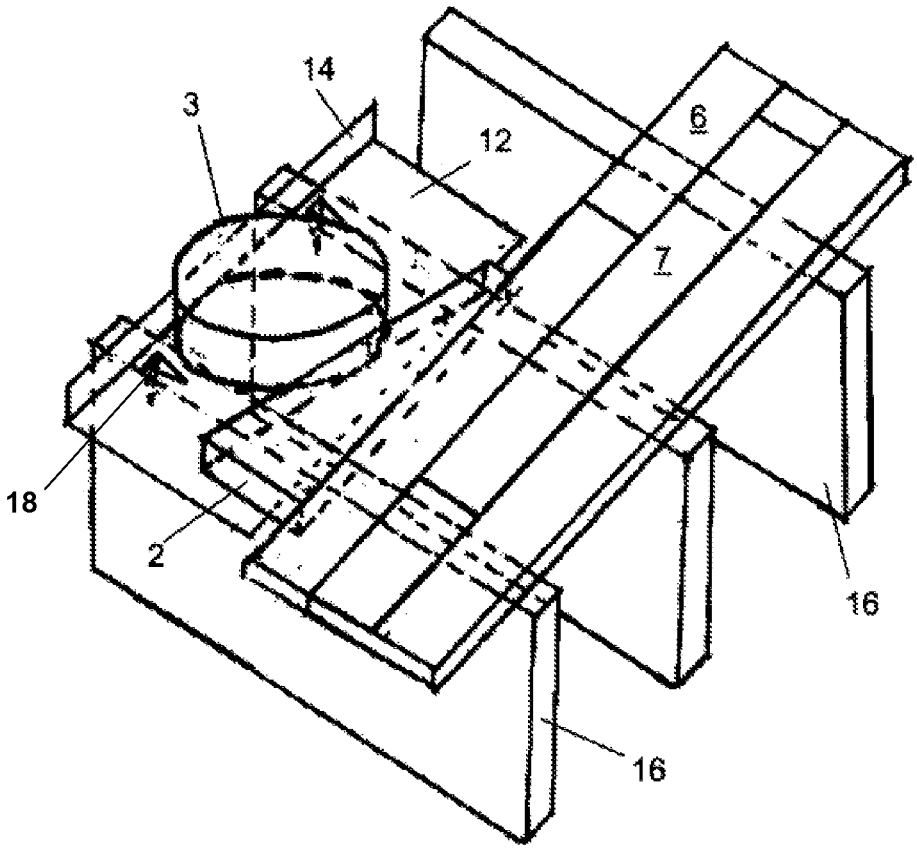
FIG. 3 is a perspective view of a flooring element locator according to another embodiment.

With reference now to FIG. 3, the removable surface includes a substantially planar sheet 12 of a rigid material (for instance steel), having a lip 14 at one edge thereof which is oriented substantially at right angles to the plane of the sheet 12. The sheet 12 is wider than the space between two joists 16 with which the removable surface is to be used, and an underside of the sheet 12 is provided with a pair of fixing means 18, spaced apart approximately the same distance as two of the joists 16.

In use of the removable surface, the removable surface is attached to the upper sides of two joists 16 by the fixing means 18 provided on the underside of the sheet 12. The removable surface is positioned so that a leading edge of the sheet 12 lies near a newly-laid flooring element, with the raised lip 14 on the edge opposite the leading edge (i.e. the edge furthest from the newly-laid flooring element). The above-described flooring locator is then used on the planar sheet 12, using the raised lip 14 as a fixed element, to locate the newly-laid flooring element properly.

Once the newly-laid flooring element has been located, the removable surface is detached from the joists 16 and can then be stored or used to locate a further flooring element.

The fixing means 18 may include cut-out triangular sections of the sheet which face downwardly, and which can be driven into the upper surfaces. Alternatively, nails or screws or any other suitable fixing means may be used.

It will be appreciated that the present embodiment(s) provide a simple yet flexible method for locating flooring elements, which can be used regardless of the space available between a newly-laid flooring element and an opposing wall, and which does not require bulky or expensive equipment.

It will be understood that the utility of the present disclosure is not restricted to the laying of flooring elements, and the disclosure may be used in any situation in which a user is required to exert a pushing force against a moveable element. Examples of such situations include the clamping of an element against another, and the separation of fixed elements from one another.

While several embodiments have been described in detail, it will be apparent to those skilled in the art that the disclosed embodiments may be modified. Therefore, the foregoing description is to be considered exemplary rather than limiting.

What is claimed is:

1. A flooring element locator, comprising:

a separating member having first and second faces inclined at an angle to one another, so that at least a part of the separating member is in the form of a wedge having a wider end and a narrower end; and a spacing member having a substantially circular cross section, the separating member being drivable between the spacing member and a flooring element in a direction passing from the wider end thereof to the narrower end thereof, thereby exerting forces on the flooring element and the spacing member in directions to separate the flooring element and the spacing member, wherein the spacing member makes rolling contact with the separating member, and wherein very little effort is required to overcome friction between the spacing element and the separating member.

2. The flooring element locator according to claim 1 wherein the flooring element locator is configured for laying flooring elements across a series of spaced-apart parallel joists which do not rest on a fixed supporting surface, and wherein the locator further comprises:

a removable, substantially planar sheet of a rigid material; and a raised locating lip defined at one edge of the sheet, the lip being oriented substantially at right angles to the plane of the sheet;

wherein the sheet is configured to cover a space between adjacent parallel joists of the series, and is further configured to receive the flooring element locator thereon and abutting the raised locating lip.

3. The flooring element locator according to claim 2 wherein an underside of the sheet includes fixing means to fix the sheet to one or more of the joists.

4. The flooring element locator according to claim 3 wherein the fixing means are spaced apart approximately the same distance as the adjacent parallel joists.

5. A flooring element locator, comprising:

a separating member having first and second faces inclined at an angle to one another, so that at least a part of the separating member is in the form of a wedge having a wider end and a narrower end; and a spacing member having a circular cross section;

wherein the separating member is configured to be drivable between the spacing member and a flooring element in a direction passing from the separating member wider end to the separating member narrower end, thereby exerting forces on the flooring element and the spacing member in directions to separate the flooring element and the spacing member, wherein the spacing member makes rolling contact with the separating member, and wherein very little effort is required to overcome friction between the spacing element and the separating member.

6. A flooring element locator, comprising:

a separating member having first and second faces inclined at an angle to one another, so that at least a part of the separating member is in the form of a wedge having a wider end and a narrower end;

a spacing member having a substantially circular cross section; and a fixed element removably disposed in a predetermined fixed location and orientation;

wherein the separating member is configured to be drivable between the spacing member and a flooring element in a direction passing from the separating member wider end to the separating member narrower end, thereby exerting forces on the flooring element and the spacing member in directions to separate the flooring element and the spacing member, wherein the spacing member makes rolling contact with the separating member, and wherein very little effort is required to overcome friction between the spacing element and the separating member.

* * * * *